US005720478A

United States Patent [19]

Carter et al.

[11] Patent Number: 5,720,478

[45] Date of Patent: Feb. 24, 1998

[54] GATELESS DUPLEX INVERTER

[75] Inventors: Daniel L. Carter, Scottsville; Stan Alan Spencer, Rochester; Carl B. Lewis, Webster; David M. Attridge, Rochester, all of N.Y.

[73] Assignee: Xerox Corporation, Stamford, Conn.

[21] Appl. No.: 721,304

[22] Filed: Sep. 26, 1996

[51] Int. Cl.[6] ..... B65H 29/00

[52] U.S. Cl. ..... 271/902; 271/902

[58] Field of Search ..... 271/902, 184, 271/185, 186, 270

[56] References Cited

U.S. PATENT DOCUMENTS

| | | | |
|---|---|---|---|
| 4,159,824 | 7/1979 | Stange | 271/184 |
| 4,168,830 | 9/1979 | Hori et al. | 271/902 |
| 4,214,740 | 7/1980 | Acquaviva | 271/3 |
| 4,359,217 | 11/1982 | Roller et al. | 271/186 |
| 4,487,506 | 12/1984 | Repp et al. | 355/14 |
| 4,673,176 | 6/1987 | Schenk | 271/186 |
| 4,993,700 | 2/1991 | Winkler | 271/186 |
| 5,449,164 | 9/1995 | Quesnel | 271/902 |

FOREIGN PATENT DOCUMENTS

| | | | |
|---|---|---|---|
| 0028465 | 1/1990 | Japan | 271/186 |
| 403200662 | 9/1991 | Japan | 271/186 |

*Primary Examiner*—M. Grant Skaggs
*Attorney, Agent, or Firm*—Kevin R. Kepner

[57] ABSTRACT

A device for inverting a sheet along a path in an electric photographic printing machine. A gateless sheet inverter is provided in which a curved portion of a sheet path branch intersects a second portion of the sheet path to form a curved inverter throat. As the sheet is driven from the curved branch portion of the path into the throat portion the beam strength of the sheet causes the trail edge of the sheet to flip toward a second nip leading to the second sheet path. A pair of reversing rolls captures the lead edge of the sheet to be inverted and then reverses to drive the sheets out of the second nip formed by a tri-roll arrangement. A sheet having a radius of curvature equal to or greater than the radius of curvature of the throat will be guided along the throat baffle and fed through the second nip. To further assist in assuring the trail edge flips to the second sheet path an air knife can be added at the intersection of the path branches to assist in moving the trail edge into the second path branch. A fixed deflector can also be added and configured so that the trail edge of the sheet is guided into the second branch of the sheet path to increase the latitude of sheet curvature that can be handled by the device, the deflector further having a curved radius on the portion of the deflector contacting the sheet so that coated sheets are not damaged.

14 Claims, 3 Drawing Sheets

GATELESS DUPLEX INVERTER

This invention relates generally to a sheet handling system, and more particularly concerns a gateless duplexing inverter device for sheets in a high speed printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In many printing machines as described above a sheet is inverted and an image is formed on the reverse side thereof to create a duplex document. As printers become faster and the range of substrates becomes broader a typical spring loaded gate type inverter presents several shortcomings. Of concern is that very lightweight substrates might not be able to move a heavily biased gate and still allow the gate to return for a previous sheet to exit. A light biasing force might accommodate the lightweight sheets but the force required is so light that when a heavyweight sheet hits the gate it will bounce and prevent the previous sheet from exiting. Additionally the inertia of heavyweight sheets continually hitting the gate would cause failure in a short period of time thus contributing to down time faults. Another detriment to a passive biased gate is that gloss or coated substrates are easily scratched, scuffed, or otherwise damaged when they come in to relative motion contact with another surface. Additionally, a gateless device is more ecomonical and has no moving parts to fail.

The following disclosures may relate to various aspects of the present invention:

U.S. Pat. No. 4,214,740 Patentee: Acquaviva Issue Date: Jul. 29, 1980

U.S. Pat. No. 4,359,217 Patentee: Roller et al. Issue Date: Nov. 16, 1982

U.S. Pat. No. 4,487,506 Patentee: Repp et al. Issue Date: Dec. 11, 1984

U.S. Pat. No. 4,673,176 Patentee: Schenk Issue Date: Jun. 16, 1987

Some portions of the foregoing disclosures may be briefly summarized as follows:

U.S. Pat. No. 4,214,740 describes a sheet reversing mechanism having drive rolls independently activated for driving sheets into and out of a sheet reversing station at different rates. A first shaft supports a drive roll engaging an idler roll supported on a second shaft and a drive roll supported on the second shaft engages an idler roll supported on a third shaft. The diameters of the idler roll and the drive roll on the second shaft are different providing corrugations in the sheets driven out of the reversing station.

U.S. Pat. No. 4,359,217 describes a tri-roll inverter that employs a corrugating roll on roll return force applicator located downstream from the tri-roll input/output members. A sheet coming into the inverter is driven by a pair of the tri-rolls into a nip formed between corrugating rings mounted on the dual rolls of the return force applicator. One of the rolls has a minimal friction force and rotates continuously in the opposite direction to the incoming sheet. When the last portion of the sheet is driven into the corrugation nip, the friction force of the nip will cause the sheet to buckle into an output nip of the tri-roll members for outward movement.

U.S. Pat. No. 4,487,506 describes a dual purpose tri-roll invertor as part of the normal paper path of a copier and has the capability of taking a sheet into the input side of tri-roll input/output members and continue feeding the sheet by the use of reversible rolls through and out of a channel portion of the inverter for further processing. Alternatively, when reversing of the sheet is required for duplexing, the reversible rolls are reversed by a reverse drive mechanism to propel the sheet while it is still in the inverter back toward the output side of the tri-rolls.

U.S. Pat. No. 4,673,176 describes a tri-roll invertor that employs a corrugation roll on roll return force applicator located downstream of and off line from the input nip of the tri-roll input/output members. A sheet driven by the input nip into the inverter is corrugated as it penetrates the roll on roll return force nip. When the last portion of the sheet is driven into the return force and computer nip, the friction return force of the nip will cause the sheet to drive into a foam roll which delivers the sheet to the output nip.

In accordance with one aspect of the present invention there is provided an apparatus for inverting a sheet moving along a paper path, comprising a first sheet path branch, said first sheet path branch having a curved configuration a second sheet path branch, intersecting said first sheet path branch to form an inverter throat, said inverter throat being curved, wherein an angle formed between said first sheet path branch and said throat is an obtuse angle and a drive mechanism for moving a sheet along said first path branch in a first direction and into said second path branch and then moving the sheet along said second path branch in a direction opposite said first direction.

Pursuant to another aspect of the present invention, there is provided an electrophotographic printing machine having a device for inverting a sheet along a paper path comprising a first sheet path branch, said first sheet path branch having a curved configuration a second sheet path branch, intersecting said first sheet path branch to form an inverter throat, said inverter throat being curved, wherein an angle formed between said first sheet path branch and said throat is an obtuse angle and a drive mechanism for moving a sheet along said first path branch in a first direction and into said second path branch and then moving the sheet along said second path branch in a direction opposite said first direction.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
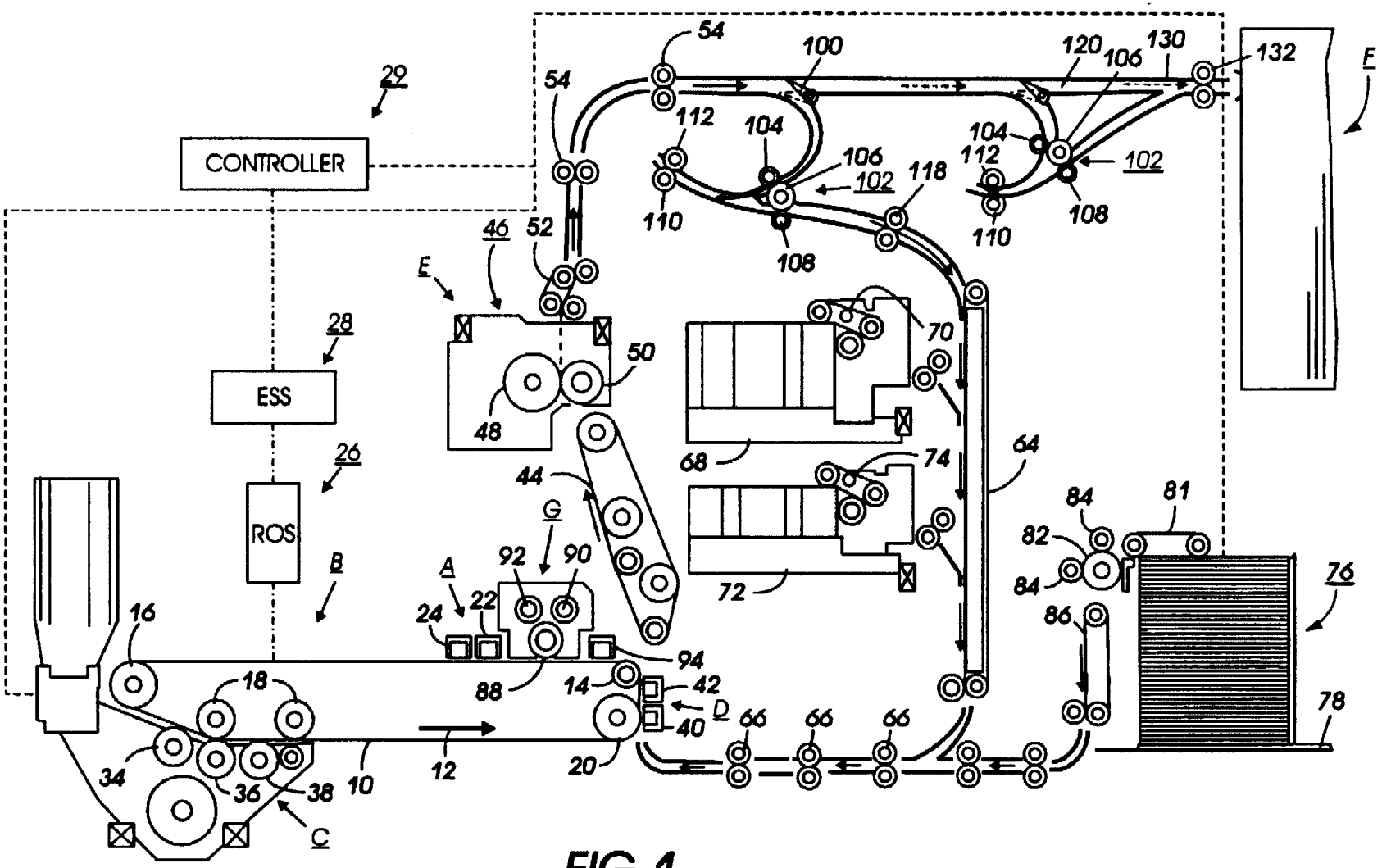
FIG. 1 is a side schematic elevational view depicting an illustrative electrophotographic printing machine incorporating a sheet inverting device of the present invention.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the inverter device of the present invention may be employed in a wide variety of machines and is not specifically limited in its application to the particular embodiment depicted herein.

Referring to FIG. 1 of the drawings, the electrophotographic printing machine employs a photoconductive belt 10. Preferably, the photoconductive belt 10 is made from a photoconductive material coated on a ground layer, which, in turn, is coated on an anti-curl backing layer. The photoconductive material is made from a transport layer coated on a selenium generator layer. The transport layer transports positive charges from the generator layer. The generator layer is coated on an interface layer. The interface layer is coated on the ground layer made from a titanium coated Mylar®. The interface layer aids in the transfer of electrons to the ground layer. The ground layer is very thin and allows light to pass therethrough. Other suitable photoconductive materials, ground layers, and anti-curl backing layers may also be employed. Belt 10 moves in the direction of arrow 12 to advance successive portions sequentially through the various processing stations disposed about the path of movement thereof. Belt 10 is entrained about stripping roller 14, tensioning roller 16, idler rolls 18 and drive roller 20. Stripping roller 14 and idler roller 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices indicated generally by the reference numerals 22 and 24 charge the photoconductive belt 10 to a relatively high, substantially uniform potential. Corona generating device 22 places all of the required charge on photoconductive belt 10. Corona generating device 24 acts as a leveling device, and fills in any areas missed by corona generating device 22. Next, the charged portion of the photoconductive surface is advanced through imaging station B.

At imaging station B, a raster output scanner (ROS), indicated generally by the reference numeral 26, discharges selectively those portions of the charge corresponding to the image portions of the document to be reproduced. In this way, an electrostatic latent image is recorded on the photoconductive surface. An electronic subsystem LESS), indicated generally by the reference numerals 28, controls ROS 26. E S S 28 is adapted to receive signals from a computer and transpose these signals into suitable signals for controlling ROS 26 so as to record an electrostatic latent image corresponding to the document to be reproduced by the printing machine. ROS 26 may include a laser with a rotating polygon mirror block. The ROS 26 illuminates the charged portion of the photoconductive surface. In this way, a raster electrostatic latent image is recorded on the photoconductive surface which corresponds to the desired information to be printed on the sheet. Other types of imaging systems may also be used employing, for example, a pivoting or shiftable LED write bar or projection LCD (liquid crystal display) or other electro-optic display as the "write" source.

Thereafter, belt 10 advances the electrostatic latent image recorded thereon to development station C. Development station C has three magnetic brush developer rolls indicated generally by the reference numerals 34, 36 and 38. A paddle wheel picks up developer material and delivers it to the developer rolls. When the developer material reaches rolls 34 and 36, it is magnetically split between the rolls with half of the developer material being delivered to each roll. Photoconductive belt 10 is partially wrapped about rolls 34 and 36 to form extended development zones. Developer roll 38 is a clean-up roll. A magnetic roll, positioned after developer roll 38, in the direction of arrow 12 is a carrier granule removal device adapted to remove any carrier granules adhering to belt 10. Thus, rolls 34 and 36 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 40 charges the copy sheet to the proper magnitude and polarity so that the copy sheet is tacked to photoconductive belt 10 and the toner powder image attracted from the photoconductive belt to the copy sheet. After transfer, corona generator 42 charges the copy sheet to the opposite polarity to detack the copy sheet from belt 10. Conveyor 44 advances the copy sheet to fusing station E.

Fusing station E includes a fuser assembly indicated generally by the reference numeral 46 which permanently affixes the transferred toner powder image to the copy sheet. Preferably, fuser assembly 46 includes a heated fuser roller 48 and a pressure roller 50 with the powder image on the copy sheet contacting fuser roller 48. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the copy sheets are fed through a decurler 52. Decurler 52 bends the copy sheet in one direction to put a known curl in the copy sheet and then bends it in the opposite direction to remove that curl. Forwarding rollers 54 then advance the sheet to duplex gate 100. Duplex solenoid gate 100 guides the sheet to the finishing station F, or to inverter 102. At finishing station F, copy sheets are stacked in a compiler tray and attached to one another to form sets. The sheets can be attached to one another by either a binder or a stapler. In either case, a plurality of sets of documents are formed in finishing station F.

When duplex solenoid gate 100 diverts the sheet into duplex path 101 the sheet is directed to the inverter 102 of the invention which will be described in detail below. The sheet is then directed back to transfer station D via conveyor 64 and rollers 66 for transfer of the toner powder image to the opposed sides of the copy sheets. The duplex sheet may then be inverted again by being directed by gate 120 into anl output inverter 102 and fed through the same path as the simplex sheet to be advanced to finishing station F.

Copy sheets are fed to transfer station D from the secondary tray 68. The secondary tray 68 includes an elevator driven by a bi-directional AC motor. Its controller has the ability to drive the tray up or down. When the tray is in the down position, stacks of copy sheets are loaded thereon or unloaded therefrom. In the up position, successive copy sheets may be fed therefrom by sheet feeder 70. Sheet feeder 70 is a friction retard feeder utilizing a feed belt and take-away rolls to advance successive copy sheets to transport 64 which advances the sheets to rolls 66 which feed the sheets to transfer station D.

Copy sheets may also be fed to transfer station D from the auxiliary tray 72. The auxiliary tray 72 includes an elevator driven by a directional AC motor. Its controller has the ability to drive the tray up or down. When the tray is in the down position, stacks of copy sheets are loaded thereon or unloaded therefrom. In the up position, successive copy sheets may be fed therefrom by sheet feeder 74. Sheet feeder 74 is a friction retard feeder utilizing a feed belt and take-away rolls to advance successive copy sheets to transport 64 which advances the sheets to rolls 66 to transfer station D.

Secondary tray 68 and auxiliary tray 72 are secondary sources of copy sheets. The high capacity sheet feeder, indicated generally by the reference numeral 76, is the primary source of copy sheets. Feed belt 81 feeds successive uppermost sheets from the stack to a take-away drive roll 82 and idler rolls 84. The drive roll and idler rolls guide the sheet onto transport 86. Transport 86 advances the sheet to rolls 66 which, in turn, move the to transfer station D.

Invariably, after the copy sheet is separated from the photoconductive belt 10, some residual particles remain adhering thereto. After transfer, photoconductive belt 10 passes beneath corona generating device 94 which charges the residual toner particles to the proper polarity. Thereafter, the pre-charge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 88 and two de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the rear of cleaning station G.

The various machine functions are regulated by a controller 29. The controller 29 is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets. In addition, the controller regulates the various positions of the gates depending upon the mode of operation selected.

The invention herein has been illustrated in a high speed black and white printing machine. It is also very suitable for use in a high speed full color or highlight color printing machine.

Figure 2:
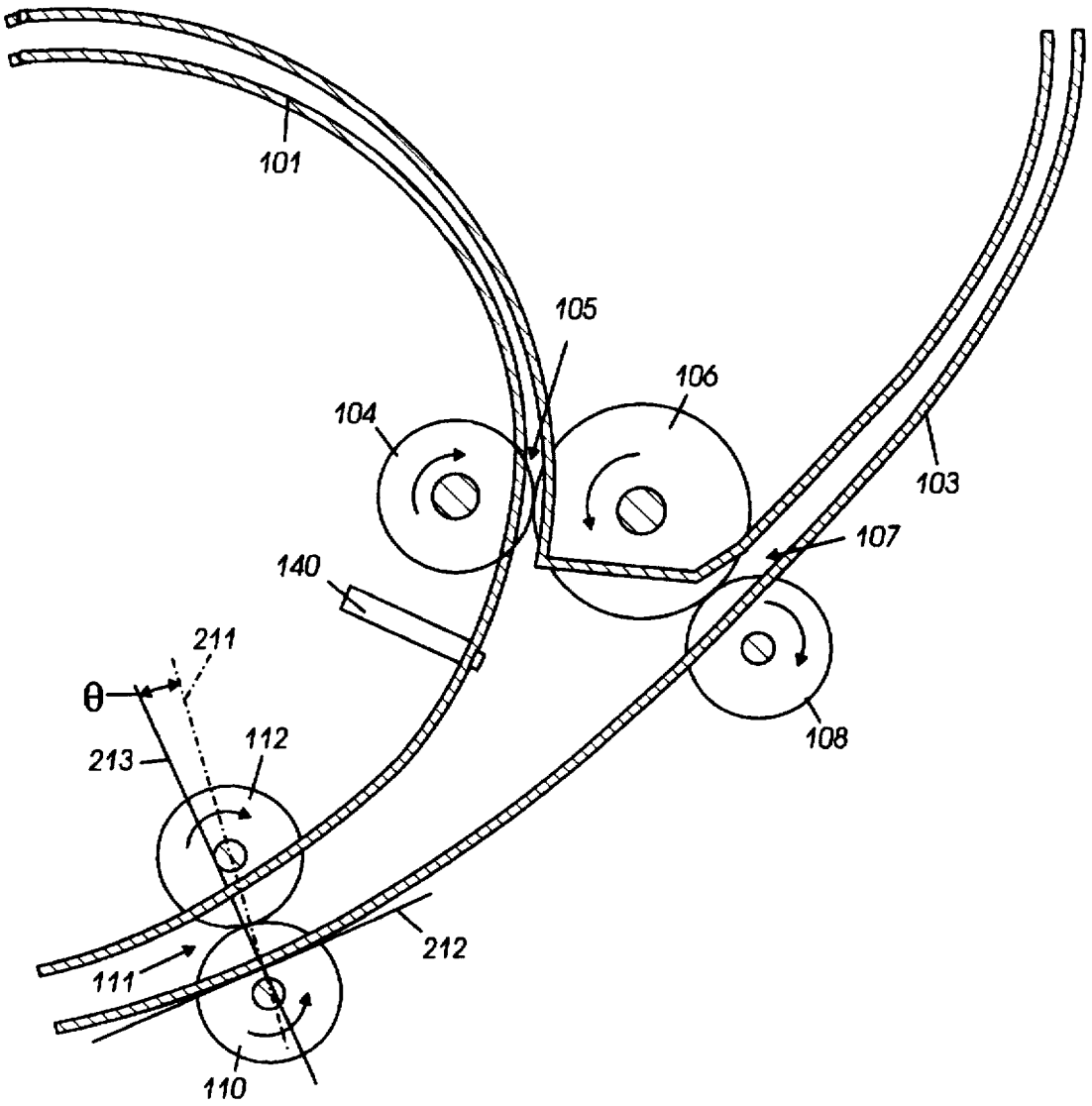
FIG. 2 is a detailed side elevational view of a first embodiment of a sheet inverter according to the invention herein.

FIG. 2 illustrates a detailed side elevation of the gateless inverter of the present invention. A sheet enters the inverter through the nip 105 formed by idler roll 104 and drive roll 106, located at the intersection of input path 101 and output path 103, along the path 101. The baffle between nips 111 and 107 is curved. As the trail end of the sheet passes through nip 105 the beam strength of the sheet causes the trail edge to flip to the lower baffle toward nip 107 formed by idler roll 108 and drive roll 106, the reversing nip 111 then drives the sheets out of the inverter toward nip 107 and the sheet is then driven by nip 107 along path 103.

The curvature of the baffle between nips 107 and 111 causes the sheet to ride along the baffle and be directed to nip 107. Also the curve of the baffle helps to minimize or eliminate sheet stubbing as the lead edge of the sheet enters the inverter. A sheet having a radius of curvature equal to or greater than the radius of curvature of the baffle will be guided along the baffle and fed through nip 107. Additionally, in the configuration shown, if a line is drawn through nip 107 and 111, the nearer the angle of the line is to zero relative to horizontal, there will be a greater gravitational assist in properly feeding a sheet through nip 107. Also, if the angle of nip 111 is moved so that a line 211 drawn through the center points of rolls 110 and 112 to the point where the line intersects a tangent 212 drawn to the curved lower baffle the nip is at an angle Θ to a perpendiclar line 213 to the tangent, curved sheets are more easily fed to nip 107. To further assist in assuring that the trail edge of the sheet is directed to the exit nip 107, an air knife 140 can be located adjacent the intersection of the branch paths 101 and 103. The air knife has the output directed so that the air assists the trail edge in being directed toward the exit nip 107.

Figure 3:
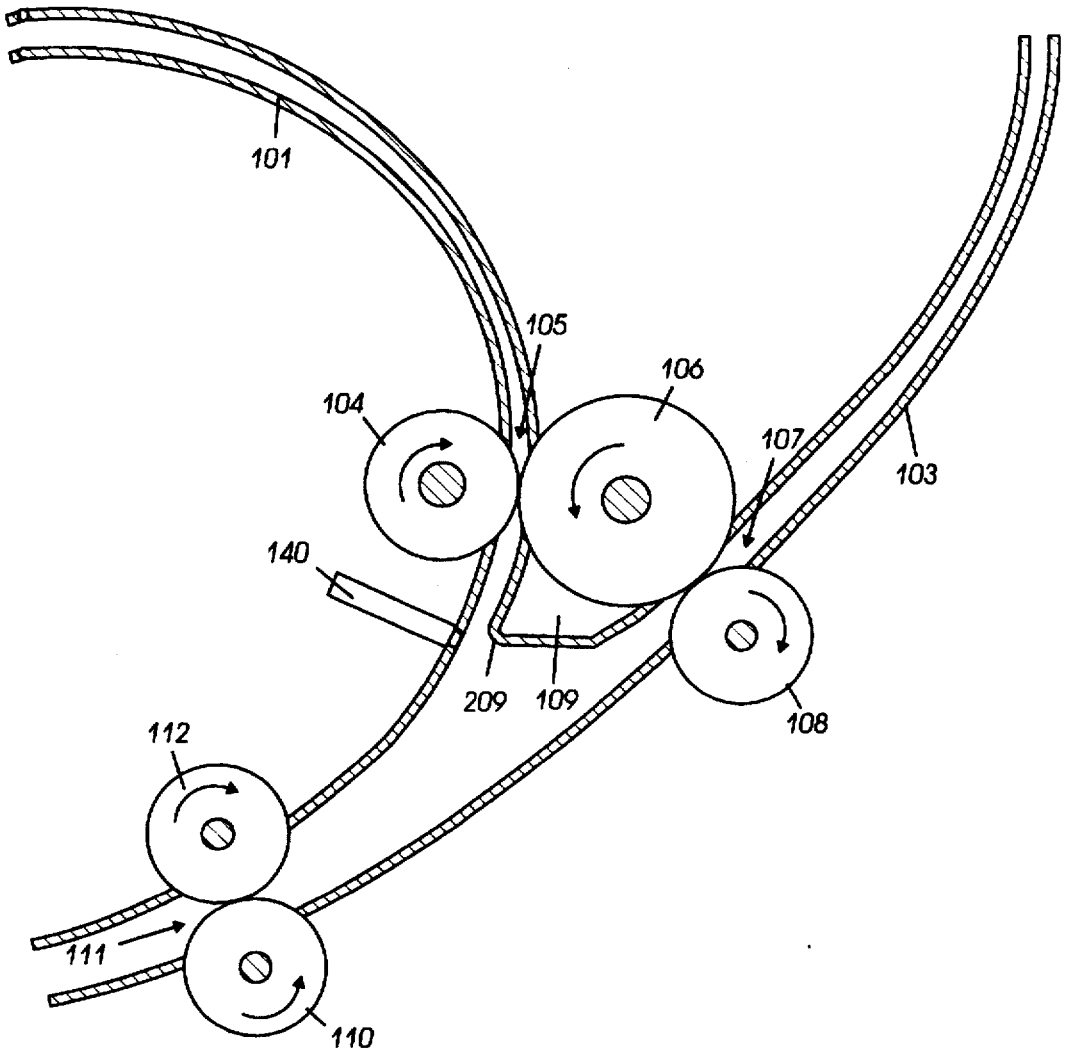
FIG. 3 is a detailed elevational view of the sheet inverter having an additional deflector therein.

As shown in FIG. 3, a further assist to directing the trail edge of the sheet to exit nip 107 can be achieved by adding a fixed diverter 109 to direct the trail edge of the sheet into nip 107. The geometry of the diverter 109 is such that the throat leading to nip 107 is much wider than the throat from nip 105 thereby increasing the likelihood that the sheet will be directed to nip 107. This geometry increases the latitude of curled sheets that can be successfully inverted in the device. Additionally, by radiusing the end, as indicated by reference numeral 209, of the diverter coated sheets are less likely to be scratched or damaged as they are inverted in the device. As an example, an inverter having a 175 mm radius of curvature and using a diverter gate can handle sheets having a radius of curvature of as little as 130 mm. Additionally, an air knife 140 can be added to this configuration to further assist in moving the trail edge toward nip 107.

In recapitulation, there is provided a device for inverting a sheet along a path in an electric photographic printing machine. A gateless sheet inverter is provided in which a curved portion of a sheet path branch insects a second portion of the sheet path to form a curved inverter throat. As the sheet is driven from the curved branch portion of the path into the throat portion the beam strength of the sheet causes the trail edge of the sheet to flip toward a second nip leading to the second sheet path. A pair of reversing rolls captures the lead edge of the sheet to be inverted and then reverses to drive the sheets out of the second nip formed by a tri-roll arrangement. A sheet having a radius of curvature equal to or greater than the radius of curvature of the throat will be guided along the throat baffle and fed through the second nip. To further assist in assuring the trail edge flips to the second sheet path an air knife can be added at the intersection of the path branches to assist in moving the trail edge into the second path branch. A fixed deflector can also be added and configured so that the trail edge of the sheet is guided into the second branch of the sheet path to increase the latitude of sheet curvature that can be handled by the device.

It is, therefore, apparent that there has been provided in accordance with the present invention, a sheet gateless duplex path inverter device that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for inverting a sheet moving along a paper path, comprising:

a first sheet path branch, said first sheet path branch having a curved configuration;

a second sheet path branch, intersecting said first sheet path branch to form an inverter throat in a third common branch formed by the intersection of said first sheet path branch and said second sheet path branch, said inverter throat being curved, wherein an angle formed between said first sheet path branch and said inverter throat is an obtuse angle; and a drive mechanism for moving a sheet along said first path branch in a first direction and into said third common branch and then moving the sheet along said second path branch in a direction opposite said first direction, wherein said drive mechanism includes a reversing nip located in said throat wherein a centerline through said nip forms an acute angle with a tangent to said curved inverter throat at the point of intersection between the centerline and the tangent.

2. An apparatus according to claim 1, wherein said drive mechanism comprises a drive roll located at the intersection of said first sheet path branch and said second sheet path branch;

a first idler roll in circumferential contact with said drive roll and forming a drive nip therewith in said first sheet path branch; and a second idler roll in circumferential contact with said drive roll to form a nip therewith in said second sheet path branch.

3. An apparatus according to claim 2, further comprising a fixed deflector located adjacent said drive roll, said deflector causing a trail edge of a sheet to be diverted from said first sheet path branch to said second sheet path branch when the sheet is reversed from said first direction to the second direction.

4. An apparatus according to claim 3, further comprising a radius on an end of said fixed diverter, said radiused end being located at a portion of said diverter where a sheet flips from said first sheet path branch to said second sheet path branch so that said diverter does not damage the sheet.

5. An apparatus according to claim 1, wherein said reversing nip located in said inverter throat formed by the intersection of said first sheet path branch and said second sheet path branch, operates first in the first direction and then reverses to operate in the second direction to drive a sheet into said second sheet path branch.

6. An apparatus according to claim 5, further comprising an air knife located adjacent the intersection of said first sheet path branch and said second sheet path branch and having an air discharge directed so as to operate on a trail edge of a sheet as the trail edge exits the nip formed between said drive roll and said first idler roll.

7. An apparatus according to claim 1, further comprising an air knife located adjacent the intersection of said first sheet path branch and said second sheet path branch and having an air discharge directed so as to operate on a trail edge of a sheet as the trail edge exits the nip formed between said drive roll and said first idler roll.

8. An electrophotographic printing machine having a device for inverting a sheet along a paper path comprising:

a first sheet path branch, said first sheet path branch having a curved configuration;

a second sheet path branch, intersecting said first sheet path branch to form an inverter throat in a third common branch formed by the intersection of said first sheet path branch and said second sheet path branch, said inverter throat being curved, wherein an angle formed between said first sheet path branch and said inverter throat is an obtuse angle; and a drive mechanism for moving a sheet along said first path branch in a first direction and into said third common branch and then moving the sheet along said second path branch in a direction opposite said first direction, wherein said drive mechanism includes a reversing nip located in said throat wherein a centerline through said nip forms an acute angle with a tangent to said curved inverter throat at the point of intersection between the centerline and the tangent.

9. A printing machine according to claim 8, wherein said drive mechanism comprises a drive roll located at the intersection of said first sheet path branch and said second sheet path branch;

a first idler roll in circumferential contact with said drive roll and forming a drive nip therewith in said first sheet path branch; and a second idler roll in circumferential contact with said drive roll to form a nip therewith in said second sheet path branch.

10. A printing machine according to claim 9, further comprising a fixed deflector located adjacent said drive roll, said deflector causing a trail edge of a sheet to be diverted from said first sheet path branch to said second sheet path branch when the sheet is reversed from said first direction to the second direction.

11. A printing machine according to claim 10, further comprising a radius on an end of said fixed deflector, said radiused end being located at a portion of said deflecter where a sheet flips from said first sheet path branch to said second sheet path branch so that said diverter does not damage the sheet.

12. A printing machine according to claim 10, further comprising an air knife located adjacent the intersection of said first sheet path branch and said second sheet path branch and having an air discharge directed so as to operate on a trail edge of a sheet as the trail edge exits the nip formed between said drive roll and said first idler roll.

13. A printing machine according to claim 8, wherein said reversing nip located in said inverter throat formed by the intersection of said first sheet path branch and said second sheet path branch, operates first in the first direction and then reverses to operate in the second direction to drive a sheet into said second sheet path branch.

14. A printing machine according to claim 8, further comprising an air knife located adjacent the intersection of said first sheet path branch and said second sheet path branch and having an air discharge directed so as to operate on a trail edge of a sheet as the trail edge exits the nip formed between said drive roll and said first idler roll.

* * * * *